US006758560B2

(12) United States Patent
Haug

(10) Patent No.: US 6,758,560 B2
(45) Date of Patent: Jul. 6, 2004

(54) FRANKING MACHINE

(75) Inventor: Werner Haug, Langnau (DE)

(73) Assignee: Frama AG, Lauperswil (CH)

( * ) Notice: Subject to any disclaimer, the term of this patent is extended or adjusted under 35 U.S.C. 154(b) by 0 days.

(21) Appl. No.: 10/276,279

(22) PCT Filed: Mar. 10, 2002

(86) PCT No.: PCT/CH02/00143

§ 371 (c)(1),
(2), (4) Date: May 12, 2003

(87) PCT Pub. No.: WO02/073541

PCT Pub. Date: Sep. 19, 2002

(65) Prior Publication Data

US 2003/0167940 A1 Sep. 11, 2003

(30) Foreign Application Priority Data

Mar. 13, 2001 (CH) ..... 460/01

(51) Int. Cl.[7] ..... B41J 2/01; B41J 2/385; B41L 47/76

(52) U.S. Cl. ..... 347/102; 347/104; 347/105; 347/140; 101/91; 101/424.4

(58) Field of Search ..... 101/91, 424.4; 347/102, 104, 105, 140

(56) References Cited

U.S. PATENT DOCUMENTS

| | | | | |
|---|---|---|---|---|
| 4,369,450 A | | 1/1983 | Iwagami et al. | |
| 5,296,873 A | * | 3/1994 | Russell et al. | 346/25 |
| 6,017,111 A | | 1/2000 | Kurata | |
| 6,340,225 B1 | * | 1/2002 | Szlucha | 347/102 |

FOREIGN PATENT DOCUMENTS

| | | |
|---|---|---|
| EP | 0416849 | 3/1991 |
| EP | 0885726 | 12/1998 |
| EP | 1040931 | 10/2000 |
| WO | 0043209 | 7/2000 |

* cited by examiner

*Primary Examiner*—Andrew H. Hirshfeld
*Assistant Examiner*—Marvin P. Crenshaw
(74) *Attorney, Agent, or Firm*—Friedrich Kueffner

(57) ABSTRACT

In franking machines (1), the printing head (2) of a printing mechanism (3) is susceptible to interference by dust particles, which are introduced by the transport of the objects to be mailed such as letters, postcards, and printed matter and by the objects themselves. It is therefore proposed that a suction air or compressed air device (9) be installed in the franking machine (1) at least in the area near the printing head (2) to protect it from dust-like foreign materials, etc.

8 Claims, 2 Drawing Sheets

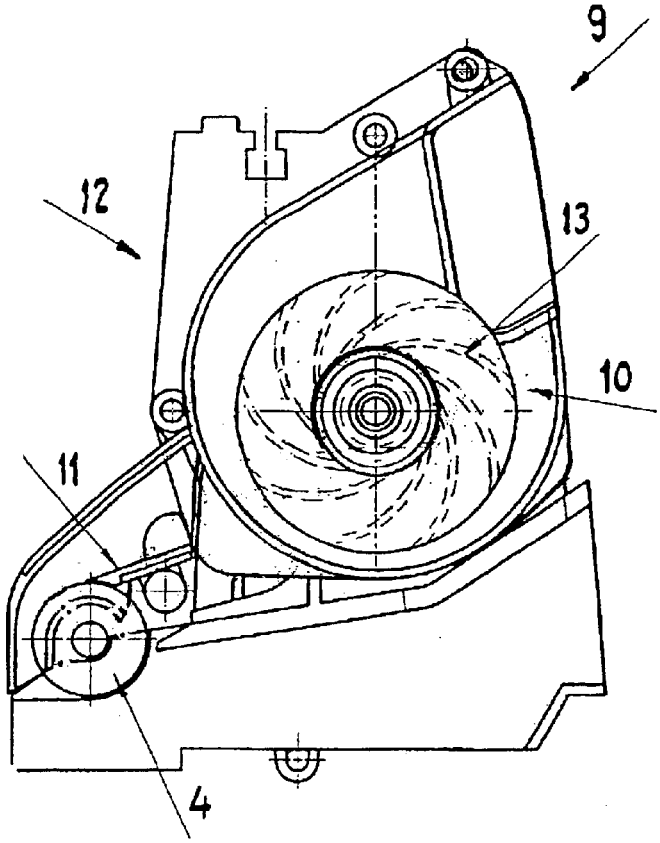
Fig. 3
Fig. 4
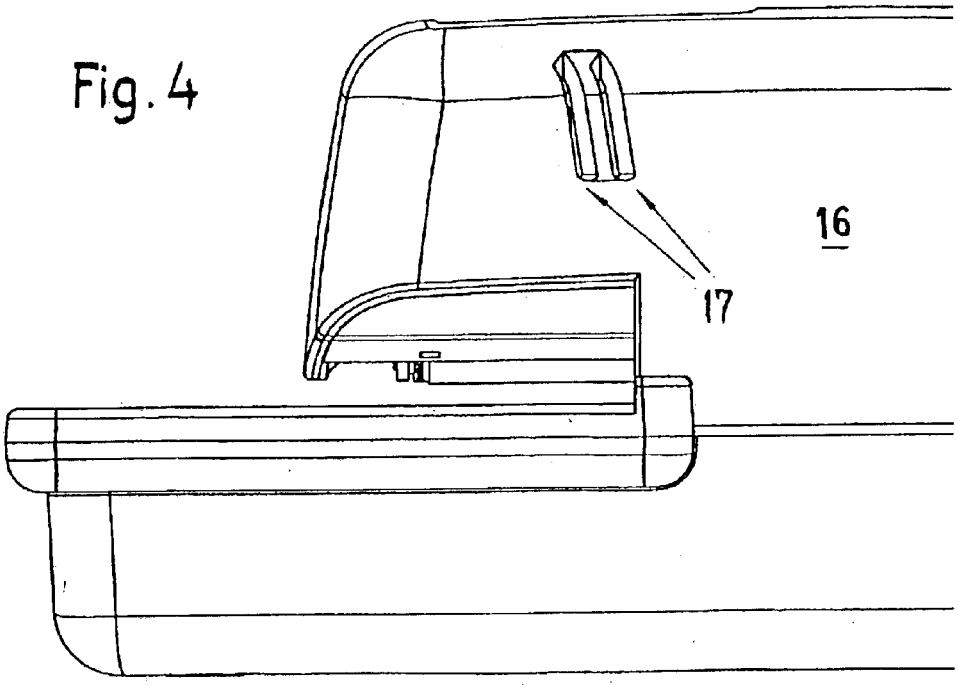

FRANKING MACHINE

BACKGROUND OF THE INVENTION

1. Field of the Invention

The invention pertains to a franking machine with at least one printing head of a printing mechanism for printing flat objects to be mailed such as letters, postcards, printed matter, etc., which can be either laid in or conducted through the machine, and with a guide arrangement, which is assigned to the print head and has a transport device, across which guide arrangement the objects to be mailed pass by the print head with their flat surfaces facing the printing mechanism.

2. Description of the Related Art

The machine in question is similar to the franking machines described in WO 01-62,503, WO 01-62,504, WO 01-62,505, and WO 01-62,506.

In addition to the standard rotary printing technique, new stamping application methods such as thermal and inkjet printing are also being used today for franking machines. It has been found in practice that especially the fussy inkjet technology reacts with great sensitivity to contamination in the area of the print head. This contamination arises primarily as a result of the dust particles which adhere to the transported objects to be mailed and which separate from the objects when they are laid in or transported through the franking machine. As a result, encrustations from on the print heads, which can interfere with the printing of the objects to be mailed to the point that the printed images or franking values become unusable or illegible.

SUMMARY OF THE INVENTION

Because such franking imprints often include barcodes, which serve to facilitate the automatic processing of the mail in mail distribution centers, the defects cited above often lead to significant costs. Because franking the same item a second time is unacceptable, inadequate franking imprints on the objects to be mailed must be reprocessed by hand, which takes a great deal of effort and leads to considerable expense.

The task of the present invention consists in designing a franking machine of the type indicated above so that it can always, that is, every time it is used, produce an imprint of uniform, high quality which is free of foreign influences, valid for its documentary purpose, and in conformity with postal requirements. In modern franking machines, inkjet technology is now being used more frequently. Special care must be taken in this case to prevent the dust carried along by the transported objects to be mailed from forming encrustations or from clogging the nozzles of the print heads. Dust also interferes with the quality of the imprints made by the other printing techniques as well, so that it is important to keep dust away from the machine in these cases as well.

According to the invention, the task described above is accomplished in that a suction device or a compressed air device is provided at least in the area near the printing head to act on the printing head in such a way as to keep it free of foreign dust-like materials, etc. It thus becomes possible to improve the reliability of the franking machine, to prolong the intervals between maintenance calls, and to maintain the good quality of the imprints.

The "area near the printing head" is intended to designate a suitable location in the immediate environment of the printing head where the suction air being carried away or the compressed air being supplied will not interfere with the proper functioning of the printing head. The use of suction air is more advantageous than that of compressed air, because the dust particles to be cleared away can be removed effectively in a current of air.

It has been found advisable for the suction air or compressed air transport device to have a blower installed in an air conduit, so that, as a result of the compact design, a space-saving arrangement can be obtained and/or the air conduit brought to an optimal point of the critical environment.

It has been found to be especially effective for the preferably nozzle-like end of the air conduit facing the area near the printing head to be located upstream of the printing head or of the printing mechanism with respect to the transport direction of the objects to be mailed.

In the case of a franking machine with a transport device operating with transport rolls rotating around axes arranged transversely to the transport direction of the objects to be mailed, it is advantageous for the end of the air conduit facing the area near the printing head to enclose at least partially a nonworking area of at least one transport roll located upstream of the printing head with respect to the transport direction of the objects to be mailed, through which the dust particles adhering to the transport roll or the paper dust separated from the objects can be carried away.

To the extent that space allows, it is effective for the end of the air conduit facing the area near the printing head to extend at least partially over the working width of the transport roll.

It is advisable for the end of the air conduit facing away from the area near the printing head to terminate outside the machine housing of the franking machine, so that the foreign materials being carried away can be disposed of simply, and thus no additional space is taken up inside the machine housing.

The end of the air conduit can in this case be designed as a collecting tank for the suctioned-out foreign materials.

To avoid the need for an additional drive motor, the blower can be connected to and driven by at least one of the driven transport rolls of the transport device.

To achieve higher rotational speeds than those of the transport rolls, a system of gears can be provided between the transport rolls and the blower to increase the rpm's of the blower.

The invention will be explained in greater detail in the following on the basis of an exemplary embodiment with reference to the drawing, which should be consulted with respect to all details not explicitly mentioned in the specification:

BRIEF DESCRIPTION OF THE DRAWINGS

FIG. 3 shows a side view of a suction transport device with a modular design; and FIG. 4 shows a partial view of a franking machine from the outside.

DETAILED DESCRIPTION OF THE PREFERRED EMBODIMENTS

Figure 1:
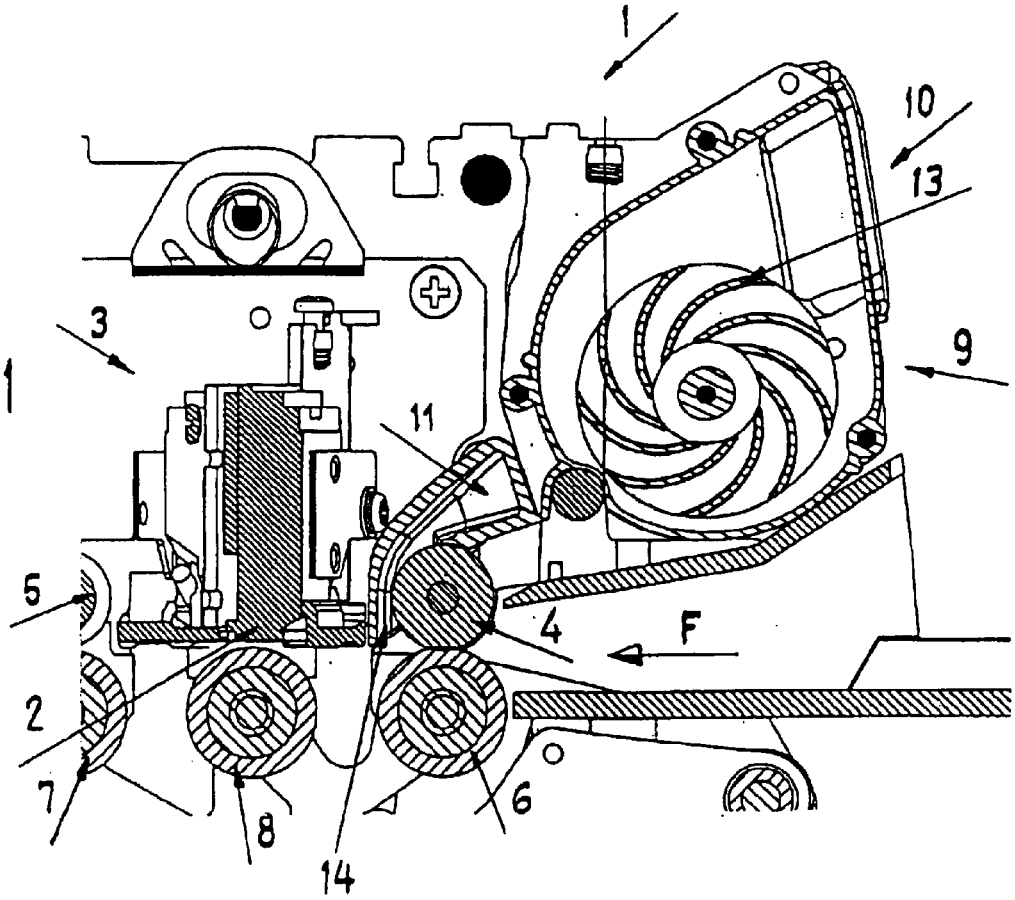
FIG. 1 shows a longitudinal cross section through a franking machine in the area near the printing head.

FIG. 1 shows part of a franking machine 1 in the area near a printing head 2 of an inkjet printing mechanism 3. It also shows the driven transport rolls 4, 5 of a transport device and the opposing counter-pressure rolls 6, 7, between which a support roll 8 is provided. The arrow F indicates the direction in which the objects to be mailed, especially letters, are being transported. A suction air transport device 9, which consists of a so-called centrifugal blower 10, is installed upstream of the printing head 2 with respect to the transport direction F; an air conduit 11 is connected to the blower on the upstream side with respect to the direction of the air flow. As can be seen in FIG. 1, the conduit extends over a nonworking area of the transport roll 4 and across its width, terminating in the impeller housing 12 of the centrifugal blower 10. The impeller 13, which is supported on a horizontal axis of rotation, draws air from the environment of the printing head 2 and the transport rolls in the axial direction and conveys it away in the upward direction.

The intake opening 14 of the air conduit 11 is designed in the form of a nozzle. A powerful suction force is thus produced, by means of which foreign materials are removed from the area near the printing head 2 and the transport roll 4.

Figure 2:
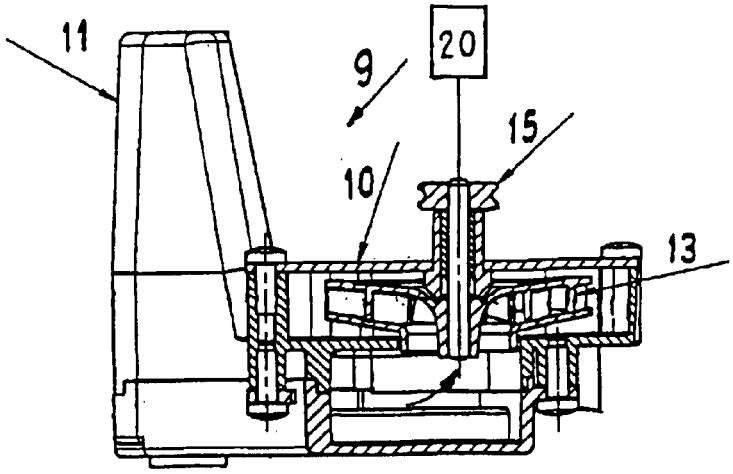
FIG. 2 shows a top view of the area near the printing head according to FIG. 1.

FIG. 1 conveys a clear idea of how the intake opening acts on the traveling objects to be mailed and on the transport roll 4. The impeller 13 is driven by way of a pulley 15, which is connected to and driven by the transport roll 4. For this purpose, transmission gearing 20 schematically shown in FIG. 2 is installed between the pulley and the roll, so that the impeller 13 can rotate at a higher speed.

The discharge end 17 of the air conduit 11 is located on the outside wall of the machine housing which encloses the franking machine 1.

FIG. 3 shows a suction air transport device 9 with a modular design.

In place of an air conduit with a continuous, slot-like intake opening, it would also be possible to provide the conduit with several individual slots or hole-like intake openings.

A chamber (not shown) could also be provided in the air conduit 11 to hold a replaceable dust collection bag. The indrawn air would flow out through the filter cloth of the dust bag, whereas the dust particles would be trapped in the dirty air in the bag. The dust bag could be monitored visually (through a window) or on the basis of a differential pressure measurement. If only a small amount of dust is formed inside the franking machine, the dust bag does not have to be provided; that is, air containing only a small amount of dust can be blown directly to the outside.

As a result of the design measures proposed here, a franking machine can be produced which allows much longer intervals between maintenance calls, produces high-quality imprints, and eliminates the need for reprocessing the imprints on the objects to be mailed. The economics of the operation of the franking machine can thus be considerably improved.

What is claimed is:

1. Franking machine (1) comprising at least one printing head (2) of a printing mechanism (3) for printing flat objects to be mailed such as letters, postcards, printed matter, etc., which can be either laid in or conducted through the machine, and a guide arrangement, which is assigned to the printing head (2) and has a transport unit, across which guide arrangement the objects to be mailed pass by the printing head (2) with their flat surfaces facing the printing mechanism (3), wherein a suction air or compressed air transport device (9) is installed at least in the area near the printing head (2) to protect it from foreign materials or the like in the form of dust, wherein the suction air or compressed air device (9) is formed by a blower (10) installed in an air conduit (11), wherein the transport unit is equipped with transport rolls (4, 5, 6, 7) rotating around axes arranged transversely to the transport direction of the objects to be mailed, wherein the end of the air conduit (11) facing the area near the printing head (2) at least partially encloses a nonworking area of at least one transport roll (4) located upstream of the printing head (2) with respect to the direction (F) in which the objects to be mailed are being transported.

2. Franking machine (1) according to claim 1, wherein a preferably nozzle-like end of the air conduit (11) facing the area near the printing head (2) is located upstream of the printing head (2) with respect to the direction (F) in which the objects to be mailed are being transported.

3. Franking machine (1) according to claim 1, wherein the end of the air conduit (11) facing the area near the printing head (2) extends at least partially over the working width of a transport roll (4).

4. Franking machine (1) according to claim 1, with a machine housing (16) enclosing the franking machine (1), wherein the end of the air conduit (11) facing away from the area near the printing head (2) terminates outside the machine housing (16).

5. Franking machine (1) according to claim 1, wherein the end of the air conduit (11) facing away from the area near the printing head (2) is designed as a collecting tank for suctioned-off foreign materials.

6. Franking machine (1) according to claim 1, wherein the blower (10) is connected to and driven by at least one of the driven rolls (4, 5) of the transport device.

7. Franking machine (1) according to claim 6, wherein the blower (10) is driven by way of a system of gears at a rotational speed which is higher than that of the transport rolls (4, 5, 6, 7).

8. Franking machine (1) according to claim 1, wherein a collecting container for dust particles similar to a filter bag is installed in the air conduit (11).

* * * * *